US006405753B1

(12) United States Patent
Beyer et al.

(10) Patent No.: US 6,405,753 B1
(45) Date of Patent: Jun. 18, 2002

(54) FUEL TANK COVER ASSEMBLY FOR FUEL TANK

(75) Inventors: Sharon Elizabeth Beyer, Grand Blanc; Dale Richard Jones, Flushing, both of MI (US); Douglas James Golla, Le Vesinet (FR); Matthew L. Catlin, Flushing, MI (US); Michael Froats, Grand Blanc, MI (US); Michael Joseph Niemiec, Brighton, MI (US); Ulf Sawert, Grand Blanc, MI (US); Jeffrey W. Beyer, Grand Blanc, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/631,064

(22) Filed: Aug. 1, 2000

(51) Int. Cl.[7] ..... F02M 37/04

(52) U.S. Cl. ..... 137/592; 123/514; 123/198 D

(58) Field of Search ..... 123/514, 198 D; 137/590, 592, 797

(56) References Cited

U.S. PATENT DOCUMENTS

| | | | | | |
|---|---|---|---|---|---|
| 4,654,191 | A | * | 3/1987 | Krieg | 137/797 |
| 4,780,063 | A | * | 10/1988 | Tuckey | 137/590 |
| 5,791,317 | A | * | 8/1998 | Eck | 123/514 |
| 5,988,213 | A | * | 11/1999 | Yoshioka | 137/590 |

* cited by examiner

*Primary Examiner*—A. Michael Chambers
(74) *Attorney, Agent, or Firm*—Vincent A. Cichosz

(57) ABSTRACT

A fuel tank cover assembly for a fuel tank of a vehicle includes a cover adapted to close an opening in the fuel tank having a fuel reservoir disposed therein, a return guide rod extending from the fuel reservoir toward the cover, and a valve disposed between the cover and the return guide rod to allow one-way flow of fuel from the cover to the fuel reservoir.

20 Claims, 3 Drawing Sheets

FUEL TANK COVER ASSEMBLY FOR FUEL TANK

TECHNICAL FIELD

The present invention relates generally to fuel tanks for vehicles and, more particularly, to a fuel tank cover assembly for a fuel tank of a vehicle.

BACKGROUND OF THE INVENTION

It is known to provide a fuel tank such as a plastic fuel tank in a vehicle to hold fuel to be used by an engine of the vehicle. In such a fuel tank, a cover is provided for a fuel reservoir. The cover typically has fuel tubes, electrical connector, and rollover valve attached thereto. The cover is made entirely out of a plastic or metal material. Guide rods are welded to the metal cover. The cover may include a return-line guide rod and a secondary device attached to the end of the guide rod to prevent reverse flow of the fuel. This secondary device is typically a rubber "duckbill" valve or a plastic valve assembly inserted in the end of the guide rod.

One concern with these fuel tanks is that the guide rods are rigidly attached to the metal cover and under severe impact conditions, the guide rods may damage the cover and sealing surface by tearing a hole in the cover or deforming the cover, resulting in a leak path, by retaining the inertia of the fuel reservoir.

Therefore, it is desirable to provide a fuel tank cover assembly for a vehicle that allows the guide rods to break away under severe impact conditions. It is also desirable to provide a fuel tank cover assembly that provides a return line check valve feature with minimal complexity.

SUMMARY OF THE INVENTION

It is, therefore, one object of the present invention to provide a new fuel tank cover assembly for a fuel tank of a vehicle.

It is another object of the present invention to provide a fuel tank cover assembly with a separate cover and break-away guide rods adapted to decouple inertia of the fuel reservoir from the cover.

It is yet another object of the present invention to provide a fuel tank cover assembly with a check valve to prevent fuel from exiting the fuel tank through the return line.

To achieve the foregoing objects, the present invention is a fuel tank cover assembly for a fuel tank of a vehicle including a cover adapted to close an opening in the fuel tank having a fuel reservoir disposed therein, a return guide rod extending from the fuel reservoir toward the cover, and a valve disposed between the cover and the return guide rod to allow one-way flow of fuel from the cover to the fuel reservoir.

One advantage of the present invention is that a fuel tank cover assembly is provided for fuel tank of a vehicle includes a valve at the cover with guide rods designed to break away. Another advantage of the present invention is that the fuel tank cover assembly has the guide rods grooved/notched just below the interface with the valve body to allow the guide rods to bend or break away under severe impact conditions while maintaining the integrity of the valve and cover. Yet another advantage of the present invention is that the fuel tank cover assembly includes a check valve that prevents fuel from exiting the fuel tank through the return line. Still another advantage of the present invention is that the fuel tank cover assembly incorporates the check valve without other major changes to the cover. A further advantage of the present invention is that the fuel tank cover assembly provides a check valve feature in the return line and reduces complexity because the check valve feature is accomplished with the addition of one injection molded piece into the return flow path with minimal investment. Yet a further advantage of the present invention is that the fuel tank cover assembly improves performance because the location of the check valve feature is in the cover allowing it to function in the event of a broken guide rod.

Other objects, features, and advantages of the present invention will be readily appreciated, as the same becomes better understood, after reading the subsequent description taken in conjunction with the accompanying drawings.

DESCRIPTION OF THE PREFERRED EMBODIMENT

Figure 1:
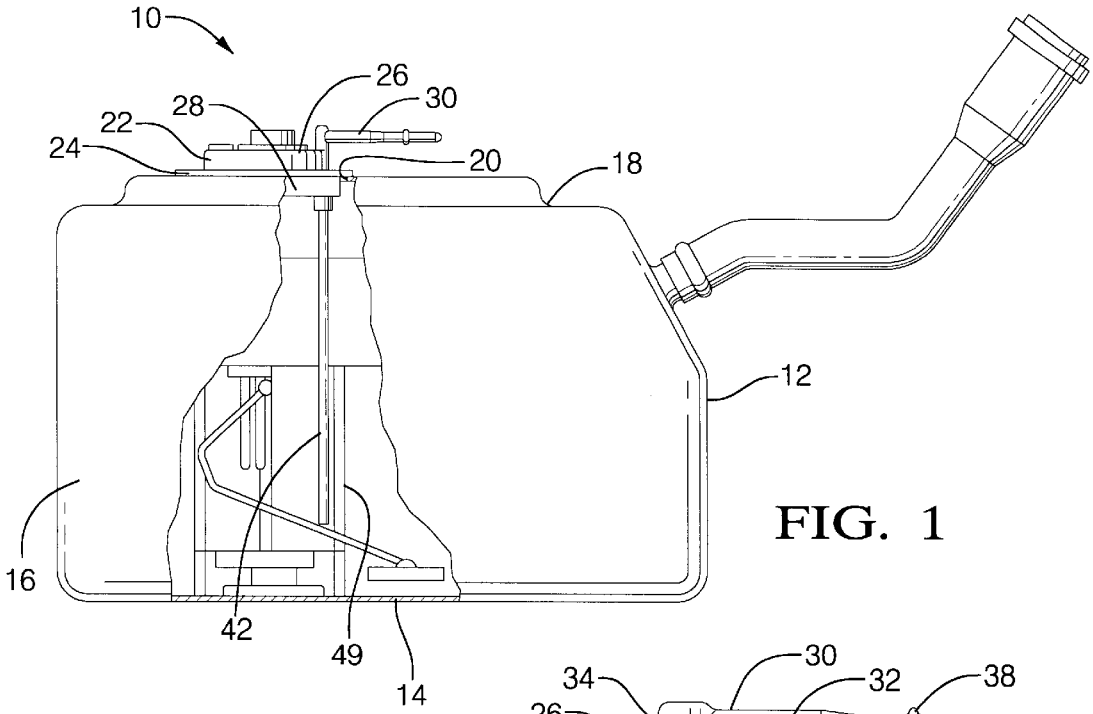
FIG. 1 is a perspective view of a fuel tank cover assembly, according to the present invention, illustrated in operational relationship with a fuel tank.
Figure 3:
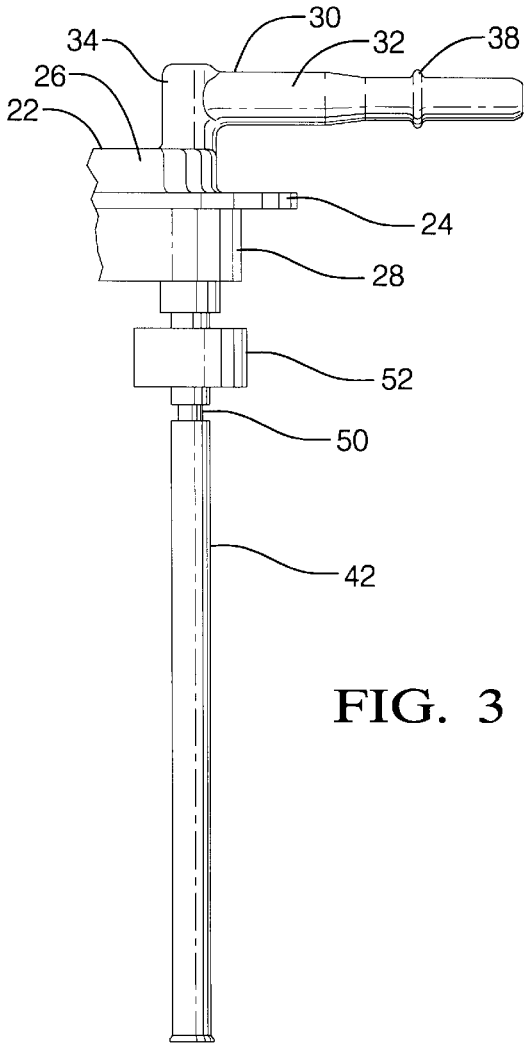
FIG. 3 is a perspective view of a check valve member of the fuel tank cover assembly of FIG. 1.
Figure 2:
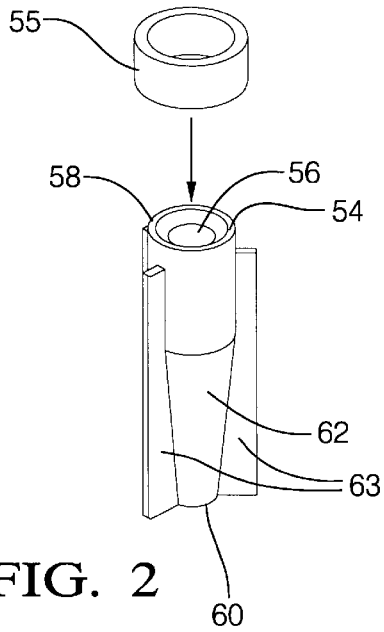
FIG. 2 is an enlarged elevational view of a return fuel line of the fuel tank cover assembly of FIG. 1.

Referring to the drawings and in particular FIGS. 1 and 2, one embodiment of a fuel tank cover assembly 10, according to the present invention, is shown for a fuel tank 12 of a vehicle (not shown). The fuel tank 12 includes a bottom wall 14 and a side wall 16 around a periphery of the bottom wall 14 and extending generally perpendicular thereto. The fuel tank 12 also includes a top wall 18 around a periphery of the side wall 16 and extending generally perpendicular thereto and generally parallel to the bottom wall 14. The top wall 18 has at least one opening therein for the fuel tank cover assembly 10. The fuel tank 12 is made of a rigid material such as plastic. It should be appreciated that, except for the fuel tank cover assembly 10, the fuel tank 12 is conventional and known in the art.

Referring to FIGS. 1 through 5, the fuel tank cover assembly 10 includes a cover 22 to cover or close the opening 20. The cover 22 is generally circular in shape. The cover 22 includes a base wall 24 having a raised portion 26. The raised portion 26 has at least one, preferably a plurality of apertures (not shown) extending therethrough for a function to be described. The cover 22 also includes a side wall 28 extending generally perpendicular and axially from the base wall 24. The cover 22 is made from a plastic material such as polybutylene (PBT) or acetyl, which is a conventional material known in the art. A retaining ring (not shown) secures the cover 22 to the top wall 18 by an o-ring or gasket 29 of rubber material forming a seal therebetween.

The fuel tank cover assembly 10 also includes a fuel return tube 30 extending from and molded to the cover 32. The fuel return tube 30 is generally "L" shaped and has an exterior or first portion 32 extending horizontally and an interior guide rod boss or second portion 34 extending vertically. The fuel return tube 30 has a passageway 36 extending axially through the first portion 32 and second portion 34. The second portion 34 extends vertically from the base wall 24 and raised portion 26 above and below the base wall 24. The first portion 32 extends horizontally from the second portion 34 above the raised portion 26 and has a flange 38 extending radially for connection to a return fuel hose or conduit (not shown) connected to an engine (not shown) of the vehicle. The second portion 34 includes a plurality of projections 40 extending radially into the passageway 36 for a function to be described. It should be appreciated that the fuel return tube 30 and cover 22 are a monolithic structure being integral, unitary and one piece.

The fuel tank cover assembly 10 includes a return guide rod 42 connected to the return fuel tube 30. The return guide rod 42 is a tubular member with a generally circular cross-sectional shape. The return guide rod 42 has a passageway 44 extending axially therethrough. The return guide rod 42 has a plurality of barbs 46 at one end which extend radially and spaced axially. The return guide rod 42 has the end disposed in the passageway 36 of the second portion 34 of the return fuel tube 30 and secured therein by the barbs 46. The return guide rod 42 also includes a groove 48 extending radially inward and spaced axially from the barbs 46. The groove 48 provides clearance at the second portion 34. The return guide rod 42 extends axially to another end within a fuel reservoir 49 disposed in the fuel tank 12 to return hot fuel to the fuel reservoir 49. The return guide rod 42 may include a breakaway mechanism such as a notch 50 extending radially inward and spaced axially from the end of the second portion 34. The notch 50 allows the return guide rod 42 to break away from the cover 22 under severe impact conditions. The return guide rod 42 may also include a check valve 52 to allow one-way flow of fuel to flow from the fuel return tube 30 to enter the fuel tank 12, but prevents fuel from exiting the fuel tank 12 through the return guide rod 42. It should be appreciated that the check valve 52 is optional and may be of a type described in connection with FIGS. 6 through 9. It should be appreciated that the fuel reservoir 49 is conventional and known in the art.

The fuel tank cover assembly 10 includes a check valve 54 between the cover 22 and the return guide rod 42 to prevent fuel from exiting the fuel tank 12. The check valve 54 is generally cylindrical in shape with a generally circular cross-section. The check valve 54 has a first end 56 with a flange 58 extending axially and circumferentially thereabout. The check valve 54 has a second end 60 axially opposite the first end 56 and a relief 58 extending axially and radially from near a mid-point to the second end 60. The second end 60 has a diameter less than the first end 56. The check valve 54 may include a plurality of fins 63 extending radially and axially to center or guide the check valve 54 in the passageway 36. The check valve 54 is made of a plastic material such as acetyl and formed by a conventional injection molding process. The check valve 54 may include a tip member 55 attached to an upper end thereof. The tip member 55 is made of an elastomeric material and molded over the upper end of the check valve 54 to improve sealing of the check valve 54 with the fuel return tube 30. The check valve 54 is disposed in the passageway 36 of the second portion 34 of the fuel return tube 30 between the end of the return guide rod 42 and the first portion 32 of the fuel return tube 30. It should be appreciated that the check valve 54 is a structure being integral and two-piece. It should also be appreciated that the check valve 54 is a one-way flow control device that is installed into the highest point of the cover 22 to ensure that the check valve 54 continues to function in the event of a broken guide rod 42. It should further be appreciated that the insertion of the check valve 54 into the fuel return tube 30 does not require orientation and accomplishes the return line check valve function with minimal changes to existing fuel return tube.

Figure 4:
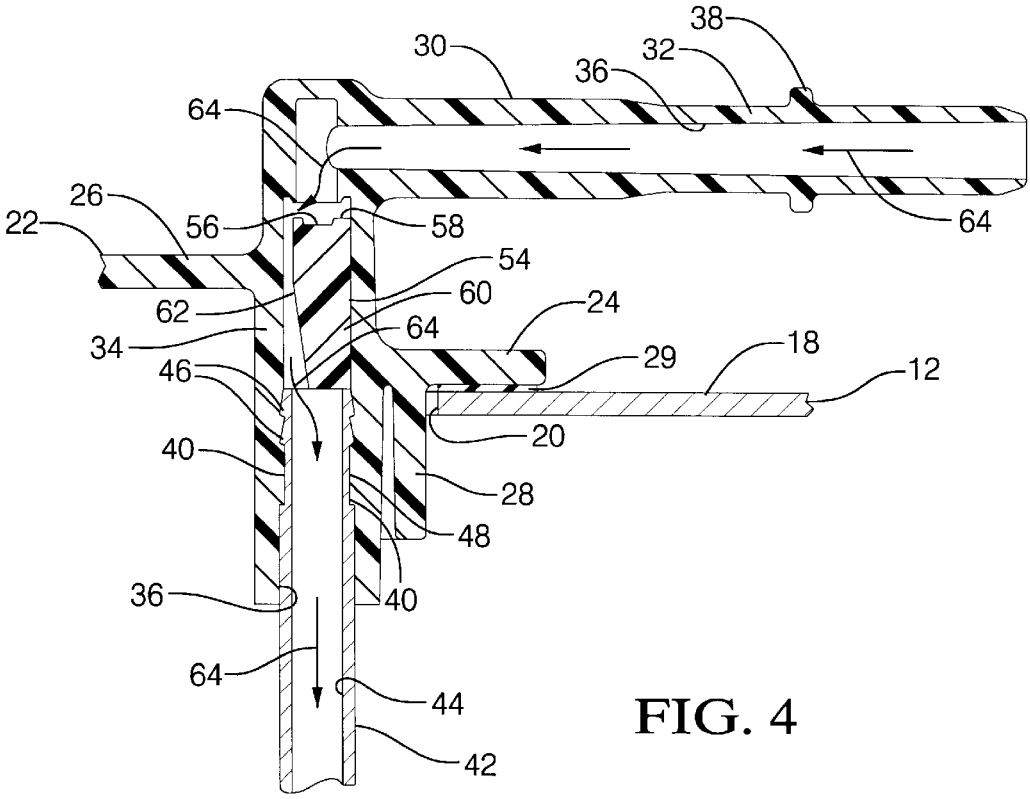
FIG. 4 is a partial fragmentary elevational view of the fuel tank cover assembly of FIG. 1 illustrating a first operational state.
Figure 5:
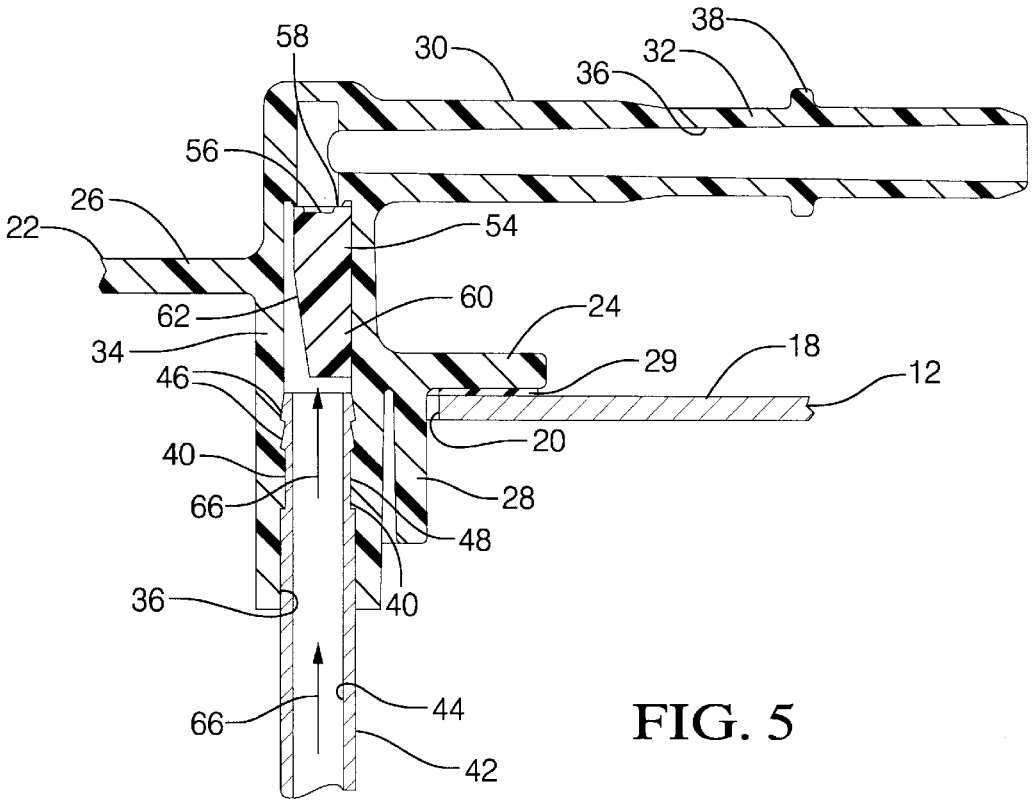
FIG. 5 is a view similar to FIG. 4 of the fuel tank cover assembly illustrating a second operational state.

Referring to FIG. 4, the return fuel as indicated by the arrows 64 flows through the passageway 36 of the return fuel tube 30, past the check valve 54, through the passageway 44 of the return guide rod 42 and into the fuel reservoir 49. As illustrated in FIG. 4, the check valve 54 is in an open state and allows return fuel flow into the fuel tank 12 without restriction. Referring to FIG. 5, exiting fuel as indicated by the arrows 66 flows through the passageway 44 of the return guide rod 42 and into the passageway 36 of the second portion 34 of the return fuel tube 30. The fuel 66 moves the check valve 54 upwardly such that the flange 58 seals against a surface of the second portion 34 to prevent the fuel from flowing into the passageway 36 of the first portion 32 of the return fuel tube 30. As illustrated in FIG. 5, the check valve 54 is in a closed state and stops the flow of fuel out of the fuel tank 12. The return guide rod 42 traps the check valve 54 in the cover 22. Under severe impact conditions, the guide rod 42 breaks away from second portion 34 of the return fuel tube 30, thereby allowing the guide rod 42 to break-away from cover 22 and leaving the cover sealing interfaces unaffected. As a result, the cover 22 and sealing interface thereof will not be damaged by retaining the inertia of the fuel reservoir 49. It should be appreciated that the fuel tank cover assembly 10 allows the guide rod 42 to break-away under severe impacts.

Figure 6:
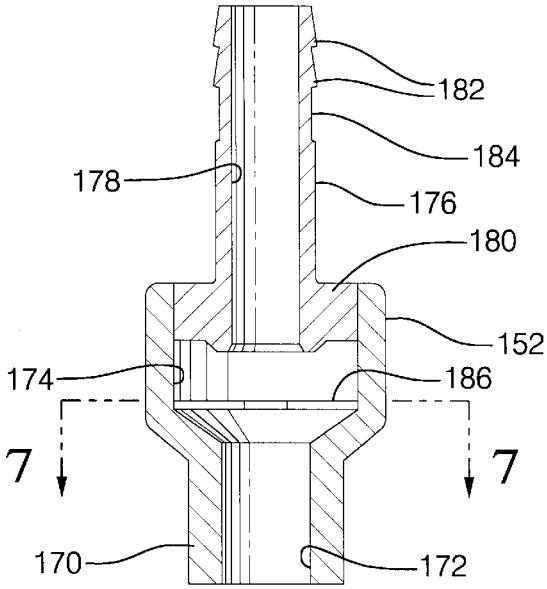
FIG. 6 is a fragmentary elevational view of another embodiment, according to the present invention, of a check valve for the fuel tank cover assembly of FIG. 1.
Figure 7:
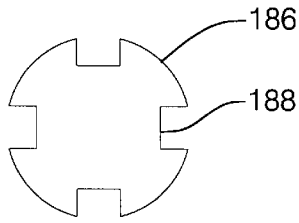
FIG. 7 is a sectional view taken along line 7—7 of FIG. 6.

Referring to FIGS. 6 and 7, another embodiment, according to the present invention, of the check valve 52 is shown. In this embodiment, the check valve 152 includes a valve body 170 connected to the return guide rod 42. The valve body 170 extends axially and has a generally circular cross-sectional shape. The valve body 170 has a passageway 172 extending axially therethrough and an enlarged cavity 174 extending axially into one end thereof. The check valve 152 also includes a valve cover 176 connected to the valve body 170. The valve cover 176 is tubular with a generally circular cross-sectional shape. The valve cover 176 has a passageway 178 extending axially therethrough. The valve cover 176 has a flange 180 at one end extending radially and disposed in the cavity 174 of the valve body 170. The valve cover 176 also has a plurality of barbs 182 at one end which extend radially and spaced axially. The valve cover 176 has the end disposed in the passageway 36 of the second portion 34 of the return fuel tube 30 and secured therein by the barbs 182. The valve cover 176 also includes a groove 184 extending radially inward and spaced axially from the barbs 182. The groove 184 provides clearance at the second portion 34. It should be appreciated that the return guide rod 42 has its passageway 44 dispose over the end of the valve body 170.

The check valve 152 also includes a valve member 186 disposed in the cavity 174 of the valve body 170 between the valve body 170 and the flange 180 of the valve cover 176. The valve member 186 is a disk style valve and is generally circular in shape. The valve member 186 has a plurality of recesses 188 extending radially inward and spaced circumferentially thereabout. The recesses 188 are generally rectangular in shape and allow fuel to flow therethrough.

In operation, flow of fuel through the check valve 152 in the normal direction from the cover 22 into the reservoir 49 provides a path for fuel flow with a very low restriction. When the fuel is subjected to a negative pressure applied at the fuel return tube 30, the valve member 186 moves into the closed position and prevents the flow of fuel out through the fuel return tube 30.

Figure 8:
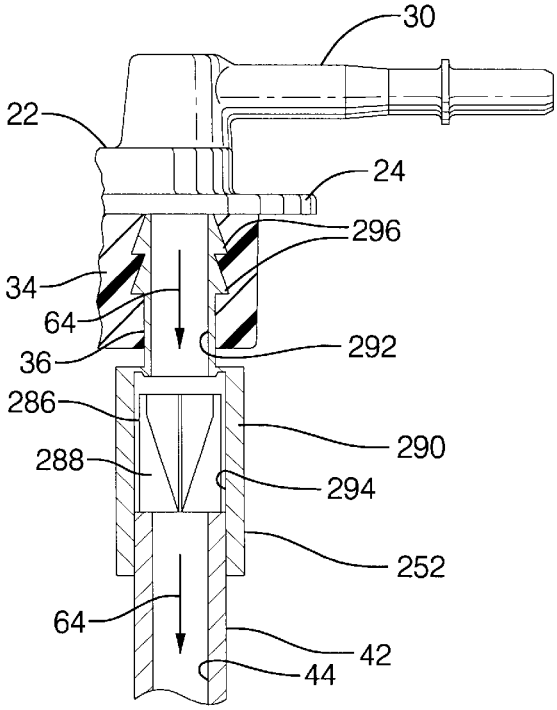
FIG. 8 is a partial fragmentary elevational view of the fuel tank cover assembly of FIG. 1 incorporating the check valve of FIG. 6 illustrating a first operational state.
Figure 9:
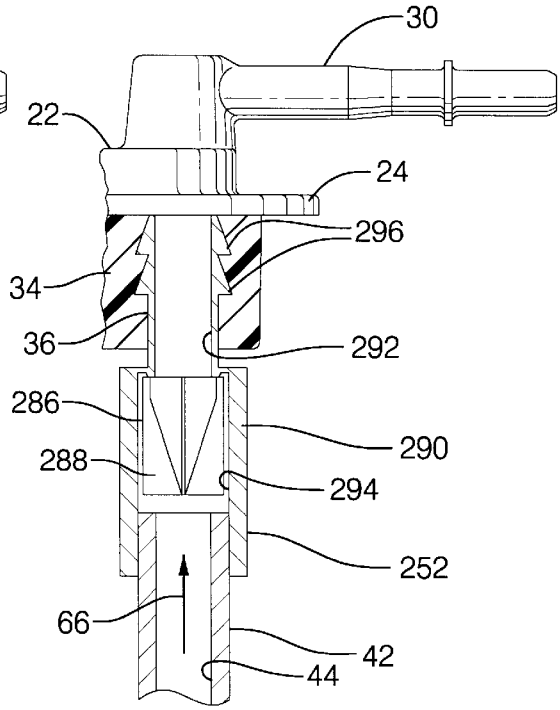
FIG. 9 is a view similar to FIG. 8 of the fuel tank cover assembly illustrating a second operational state.

Referring to FIGS. 8 and 9, yet another embodiment, according to the present invention, of the check valve 52 is shown. In this embodiment, the check valve 252 includes a valve housing 290 connected to the return guide rod 42. The valve housing 290 extends axially and has a generally circular cross-sectional shape. The valve housing 290 has a passageway 292 extending axially therethrough and an enlarged cavity 294 extending axially into one end thereof. The valve housing 290 also has a plurality of barbs 296 at one end which extend radially and spaced axially. The valve housing 296 has the end disposed in the passageway 36 of the second portion 34 of the return fuel tube 30 and secured therein by the barbs 296. It should be appreciated that the return guide rod 42 is disposed in the cavity 294 of the valve housing 290.

The check valve 252 also includes a valve member 286 disposed in the cavity 294 of the valve housing 290 between the return guide rod 42 and the valve housing 290. The valve member 286 is a plunger style valve and is generally cylindrical in shape. The valve member 286 has a plurality of recesses 188 extending axially and spaced circumferentially thereabout. The recesses 188 are generally triangular in shape and allow fuel to flow therethrough.

Referring to FIG. 8, the return fuel as indicated by the arrows 64 flows through the passageway 36 of the return fuel tube 30, through the passageway 292 of the valve housing 290, past the valve member 286, through the passageway 44 of the return guide rod 42 and into the fuel reservoir 49. As illustrated in FIG. 8, the check valve 252 is in an open state for flow of fuel through the check valve 252 in a normal direction from the cover 22 into the reservoir 49 and allows return fuel flow into the fuel tank 12 without restriction. Referring to FIG. 9, fuel as indicated by the arrows 66 flows through the passageway 44 of the return guide rod 42 and into the cavity 294 of the valve housing 290 of the check valve 252. The fuel 66 moves the valve member 286 upwardly such that the valve member 286 seals against a surface of the second portion 34 to prevent the exiting fuel from flowing into the passageway 36 of the first portion 32 of the return fuel tube 30. As illustrated in FIG. 9, the check valve 252 is in a closed state when the fuel is subjected to a negative pressure applied at the fuel return tube 30 and the valve member 286 prevents the flow of fuel out through the fuel return tube 30.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A fuel tank cover assembly for a fuel tank of a vehicle comprising:

a cover adapted to close an opening in the fuel tank having a fuel reservoir disposed therein;

a return guide rod having a first end operatively connected to said cover and a second end extending toward the fuel reservoir to return fuel to the fuel reservoir; and a valve disposed between said cover and said first end of said return guide rod to allow one-way flow of fuel from said cover to the fuel reservoir.

2. A fuel tank cover assembly as set forth in claim 1 including a breakaway mechanism on said guide rod to decouple inertia of the fuel reservoir from said cover under severe impact conditions.

3. A fuel tank cover assembly as set forth in claim 2 wherein said breakaway mechanism is a notch extending radially into said return guide rod below said valve.

4. A fuel tank cover assembly as set forth in claim 1 wherein said cover includes a return fuel tube having a passageway extending through said cover.

5. A fuel tank cover assembly as set forth in claim 4 wherein said valve comprises a valve member disposed in said passageway and movable therein between an open state to allow fluid flow from said return fuel tube to said return guide rod and a closed state to prevent fluid flow from said return guide rod to said return fuel tube.

6. A fuel tank cover assembly as set forth in claim 4 wherein said valve comprises a valve body interconnecting said cover and said return guide rod.

7. A fuel tank cover assembly as set forth in claim 6 wherein said valve body has a passageway extending therethrough and a cavity extending into one end of said valve body and communicating with said passageway.

8. A fuel tank cover assembly as set forth in claim 7 wherein said valve further comprises a valve member disposed in said cavity and movable therein between an open state to allow fluid flow from said return fuel tube to said return guide rod and a closed state to prevent fluid flow from said return guide rod to said return fuel tube.

9. A fuel tank cover assembly as set forth in claim 8 wherein said valve member comprises a disk having at least one aperture extending therethrough.

10. A fuel tank cover assembly as set forth in claim 8 wherein said valve member comprises a plunger having at least one recess extending axially therealong.

11. A fuel tank cover assembly as set forth in claim 4 wherein said return fuel tube is molded to said cover.

12. A fuel tank cover assembly for a fuel tank of a vehicle comprising:

a plastic cover adapted to close an opening in the fuel tank having a fuel reservoir disposed therein, said cover including a return fuel tube molded thereto having a passageway extending through said cover;

a return guide rod having a first end operatively connected to said cover and a second end extending toward the fuel reservoir to return fuel to said fuel reservoir; and a valve disposed between said return fuel tube and said first end of said return guide rod to allow one-way flow of fuel from said cover to the fuel reservoir.

13. A fuel tank cover assembly as set forth in claim 12 including a breakaway mechanism on said guide rod to decouple inertia of the fuel reservoir from said cover under severe impact conditions.

14. A fuel tank cover assembly as set forth in claim 13 wherein said breakaway mechanism is a notch extending radially into said return guide rod below said valve.

15. A fuel tank cover assembly as set forth in claim 12 wherein said valve comprises a check valve disposed in said passageway and movable therein between an open state to allow fluid flow from said return fuel tube to said return guide rod and a closed state to prevent fluid flow from said return guide rod to said return fuel tube.

16. A fuel tank cover assembly as set forth in claim 12 wherein said valve comprises a valve body interconnecting said cover and said return guide rod having a second passageway extending therethrough and a cavity extending into one end of said valve body and communicating with said second passageway.

17. A fuel tank cover assembly as set forth in claim 16 wherein said valve further comprises a valve member disposed in said cavity and movable therein between an open state to allow fluid flow from said return fuel tube to said return guide rod and a closed state to prevent fluid flow from said return guide rod to said return fuel tube.

18. A fuel tank cover assembly as set forth in claim 17 wherein said valve member comprises a disk having at least one aperture extending therethrough.

19. A fuel tank cover assembly as set forth in claim 17 wherein said valve member comprises a plunger having at least one recess extending axially therealong.

20. A fuel tank for a vehicle comprising:

a fuel tank having an opening formed in a wall thereof;

a fuel reservoir disposed in said fuel tank;

a return guide rod having a first end operatively connected to said cover and a second end disposed within said fuel reservoir to return fuel to said fuel reservoir;

a fuel tank cover assembly to close said opening; and wherein said fuel tank cover assembly comprises a plastic cover having a return fuel tube molded thereto with a passageway extending through said cover and a valve disposed between said return fuel tube and said first end of said return guide rod to allow one-way flow of fuel from said cover to said fuel reservoir.

* * * * *